US005962209A

United States Patent [19]

Marui

[11] Patent Number: 5,962,209

[45] Date of Patent: Oct. 5, 1999

[54] SILVER HALIDE LIGHT SENSITIVE PHOTOGRAPHIC MATERIAL

[75] Inventor: Toshiyuki Marui, Hino, Japan

[73] Assignee: Konica Corporation, Japan

[21] Appl. No.: 08/972,918

[22] Filed: Nov. 18, 1997

[30] Foreign Application Priority Data

Nov. 21, 1996 [JP] Japan ..... 8-310629

[51] Int. Cl.[6] ..... G03C 1/035; G03C 1/35; G03C 1/09

[52] U.S. Cl. ..... 430/559; 430/567; 430/603; 430/966

[58] Field of Search ..... 430/567, 966, 430/559, 603

[56] References Cited

U.S. PATENT DOCUMENTS 5,707,792 1/1998 Yamada et al. ..... 430/561

*Primary Examiner*—Mark F. Huff

*Attorney, Agent, or Firm*—Jordan B. Bierman; Bierman, Muserlian and Lucas

[57] ABSTRACT

A silver halide light sensitive photographic material is disclosed, comprising a support having thereon a silver halide emulsion layer containing silver halide grains, wherein at least 50% of the total projected area of silver halide grains contained in the silver halide emulsion layer is accounted for by tabular silver halide grains having an aspect ratio of 2 to 15, (100) major faces with an edge ratio of 1 to 2, and a silver chloride content of 50 mol % or more; and the emulsion layer further containing a leuco compound capable of forming a blue dye upon reaction with an oxidation product of a developing agent.

10 Claims, No Drawings

SILVER HALIDE LIGHT SENSITIVE PHOTOGRAPHIC MATERIAL

FIELD OF THE INVENTION

The present invention relates to a silver halide light sensitive photographic material and a processing method thereof, in particular to a silver halide light sensitive photographic material which is superior in silver image tone even when processed at a low replenishing rate and a processing method thereof.

BACKGROUND OF THE INVENTION

For the purpose of improving yellowish silver image tone, due to reduced silver content or the use of tabular silver halide grains in black-and-white photographic materials, and specifically in X-ray photographic materials, there has been attempted incorporation of a leuco dye into the photographic material. In recent processing system in which the processing time is greatly shortened and the replenishing rate of the processing solution is reduced, however, there are problems such that the dye forming rate is lowered and desired effects can not be attained. If an incorporation amount of the leuco dye is increased to compensate lowering of its dye forming rate, storage stability of the photographic material is deteriorated, resulting in variation of sensitivity and increased fog density, and therefore it is not a useful means for improvement.

A silver halide photographic material containing a leuco dye is liable to be affected by the activity of the processing solution. Specifically in rapid processing or processing at a low replenishing rate can not be obtained stable sensitometric performance and there is a problem that an image density is lowered, leading to decreased sensitivity and contrast, or to uneven developed density. This deteriorated performance adversely affects radiographic diagnosis, and an improvement thereof is desired.

SUMMARY OF THE INVENTION

An objective of the present invention is to provide a silver halide light sensitive photographic material which is superior in silver image tone, little in developing unevenness and improved in process stability, even when subjected to rapid processing or processing at a low replenishing rate, taking into account environmental concerns, and a processing method thereof.

The objective of the present invention can be accomplished by the following constitution.

(1) A silver halide light sensitive photographic material comprising a support having thereon a silver halide emulsion layer, wherein at least 50% of the projected area of silver halide grains contained in the silver halide emulsion layer is accounted for by tabular silver halide grains
   (i) having a silver chloride content of 50 to 100 mol %,
   (ii) having an aspect ratio of 2 to 15, and
   (iii) bonded by (100) major faces with an edge ratio (long edge length/short edge length) of 1 to 2;

and the emulsion layer further containing a leuco compound capable of forming a blue dye upon reaction with an oxidation product of a developing agent;

(2) the silver halide photographic material described in above (1), wherein the silver halide grains are chemically sensitized in the presence of a selenium compound and/or a tellurium compound; and (3) a method for processing the silver halide photographic material described in above (1) or (2), by the use of an automatic processor, within a total processing time (Dry to Dry) of 10 to 45 sec and at 30 to 180 ml/M$^2$ of developer replenishing rate and fixer replenishing rate.

DETAILED DESCRIPTION OF THE INVENTION

The silver halide emulsion layer according to the invention contains a leuco compound capable of forming a blue dye upon reaction with an oxidation product of a developing agent. The leuco compound usable in the invention is preferably one represented by the following formulas (I) to (VII).

Formula (I)

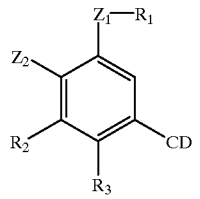

Formula (II)

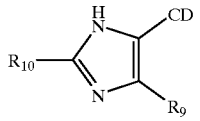

Formula (III)

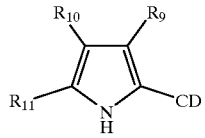

Formula (IV)

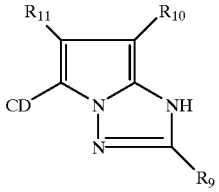

Formula (V)

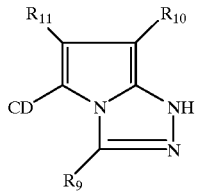

Formula (VI)

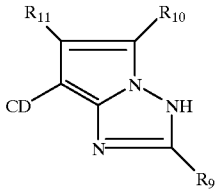

-continued

Formula (VII)

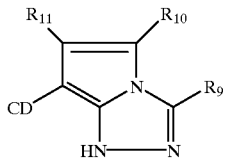

wherein $R_1$ represents an aryl group or a heterocyclic group; $R_2$ represents a hydrogen atom, an alkyl group or a halogen atom; $R_3$ represents a hydrogen atom, an alkyl group or an acylamino group; $Z_1$ represents —NHCO—, —CONH— or —NHCONH—; $Z_2$ represents —OH or —$NHSO_2R_{12}$. in which $R_{12}$ represents an alkyl group or an aryl group; and $R_9$, $R_{10}$ and $R_{11}$ independently represent a hydrogen atom or a non-metallic atomic group, provided that $R_{10}$ and $R_{11}$ may combine with each other to form a ring; CD is represented by the following formula (CD):

formula (CD)

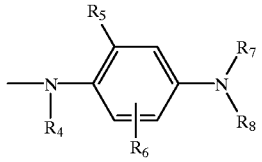

wherein $R_4$ represents a hydrogen atom, —$COR_{13}$ or —$SO_2R_{13}$, in which $R_{13}$ represents an alkyl group or an aryl group; $R_5$ and $R_6$ independently represent a hydrogen atom, an alkyl group, an alkoxy group, acylamino group or a halogen atom; $R_7$ and $R_8$ independently represent a hydrogen atom, an alkyl group, an aryl group or an acyl group, or may represent an atomic group necessary to form a 5- or 6-membered N-containing ring by combination with each other or an atomic group necessary to form a 5- or 6-membered N-containing fused ring with the phenyl ring to which the N atom is attached.

Examples of the leuco compound capable of forming a blue dye upon reaction with an oxidation product of a developing agent include indoaniline type leuco dyes, indamine type leuco dyes, triphenylmethane type leuco dyes, triarylmethane type leuco dyes, styryl type leuco dyes, N-acyloxazine type leuco dyes, N-acylthiazine type leuco dyes, N-acyldiazine type leuco dyes, and xanthene type leuco dyes. Of these are preferably compounds represented by formulas (I) to (VII).

In formulas (I) to (VII), an aryl group represented by $R_1$ is preferably one having 6 to 10 carbon atoms (e.g., phenyl, naphthyl), which may be substituted by a substituent (e.g., an alkyl group, dialkylamino group, alkoxy group, aryloxy group, halogen atom such as fluorine, chlorine or bromine, alkoxycarbonyl group, acylamino group, carbamoyl group, alkylcarbamoyl group, arylcarbamoyl group, alkylsulfonamido group, arylsulfonamido group, sulfamoyl group, alkylsulfamoyl group, alkylsulfonyl group, cyano group, nitro group). A heterocyclic group represented by $R_1$ (e.g., pyridyl group, quinolyl group, furyl group, benzothiazolyl group, oxazolyl group, imidazolyl group) may be substituted by the same substituent as described in the aryl group.

An alkyl group represented by $R_2$ or $R_3$ is preferably one having 1 to 3 carbon atoms (e.g., methyl, ethyl, propyl). In cases where $R_2$ and $R_3$ combine with each other to form a ring, the ring is preferably a benzene ring.

$Z_1$ represents —NHCO—, —CONH— or —NHCONH—; and $Z_2$ represents —OH, —$NHSO_2R_{12}$ in which $R_{12}$ represents an alkyl group or aryl group.

CD is represented by formula (CD), wherein $R_4$ represents a hydrogen atom, —$COR_{13}$ or —$SO_2R_{13}$. in which $R_{13}$ represents an alkyl group or an aryl group; $R_5$ and $R_6$ independently represent a hydrogen atom, an alkyl group, an alkoxy group, acylamino group or a halogen atom; $R_7$ and $R_8$ independently represent a hydrogen atom, an alkyl group, an aryl group or an acyl group, $R_7$ and $R_8$ combine with each other to form a 5 or 6-membered nitrogen-containing ring, or $R_7$ or $R_8$ combines with $R_6$ to form a 5 or 6-membered nitrogen-containing ring or represent an atomic group necessary to form a 5- or 6-membered nitrogen containing fused ring with the phenyl group to which the nitrogen atom is attached.

Of halogen atoms represented $R_2$, $R_5$ or $R_6$ (e.g., F, Cl, Br, I) is preferably Cl.

An alkyl group represented by $R_5$, $R_6$, $R_7$, $R_8$, $R_{12}$ or $R_{13}$ is a straight chained or branched alkyl group having 1 to 20 carbon atoms (e.g., methyl, ethyl, n-butyl, t-butyl, n-octyl, n-hexyl), which may be substituted by a substituent (e.g., a halogen atom, an alkoxy group, aryloxy group, an alkoxycarbonyl group, an aryloxycarbonyl group, a carbonyl group, a hydroxy group, an acylamino group, a carbamoyl group, a sulfamoyl group, a sulfonamido group, cyano group).

An aryl group represented by $R_7$, $R_8$, $R_{12}$ or $R_{13}$ is one having 6 to 10 carbon atoms and the same as defined in $R_{11}$.

An alkoxy group represented by $R_5$ or $R_6$ is preferably one having 1 to 20 carbon atoms (e.g., methoxy, ethoxy, n-butoxy, n-hexyloxy, n-decyloxy, isopropyloxy, 2-methoxyethoxy, 2-chloroethoxy), which may be substituted. An acylamino group represented by $R_3$, $R_5$ or $R_6$ is preferably one having 2 to 30 carbon atoms (e.g., acetylamino, propionylamino, butylylamino, myristylamino, stearoylamino, pivaloylamino, benzoylamino), which may be substituted by a substituent (e.g., alkoxy, phenoxy, alkyl-substituted phenoxy).

An acyl group represented by $R_7$ or $R_8$ is preferably one having 2 to 20 carbon atoms (e.g., acetyl, propionyl, butylyl, benzoyl, lauroylisobutyl). The 5- or 6-membered N-containing rings formed by combination of R and $R_8$ includes a piperidine ring, pyrrolidine ring and morpholine ring. $R_7$ and $R_6$ may also represent an atomic group necessary to form a 5- or 6-membered N-containing fused ring with the phenyl ring to which the N atom is attached.

In formula (I), it is preferred that $R_1$ is an aryl group, $R_2$ is a hydrogen atom and $R_3$ is an acylamino group.

$R_9$, $R_{10}$ and $R_{11}$ represent a hydrogen atom or a non-metallic substituting group. Concretely, $R_9$, $R_{10}$ and $R_{11}$ independently represent a hydrogen atom, an aryl group, a heterocyclic group, an alkyl group, cyano group, acyl group, carbamoyl group, alkoxycarbonyl group, an aryloxycarbonyl group, acylamino group, alkoxycarbonylamino group, aryloxycarbonylamino group, a sulfonylamino group, aminocarbonylamino group, a sulfamoylamino group, amino group (including an anilino group), an alkoxy group, an aryloxy group, silyloxy group, a heterocyclic-oxy, an alkylthio group, an arylthio group, a heterocyclic-thio group, a halogen atom, a hydroxy group, a nitro group, a sulfamoyl group, a sulfonyl group, an azo group, an acyloxy group, a carbamoyloxy group, an imido group, a sulfinyl group, a phospholyl group, or an azolyl. Preferred examples of $R_9$, $R_{10}$ and $R_{11}$ include a hydrogen atom, an aryl group (preferably having 6 to 20 carbon atoms, such as phenyl, m-acetylaminophenyl or p-methoxyphenyl), an alkyl group (preferably having 1 to 20 carbon atoms, such as methyl, ethyl, iso-propyl, t-butyl, n-octyl or n-dodecyl),a cyano group, an acyl group (preferably having 1 to 20 carbon atoms, such as acetyl, pivaloyl, benzoyl, furoyl or 2-pyridylcarbonyl), a carbamoyl group (preferably having 1 to 20 carbon atoms, such as methylcarbamoyl, ethylcarbamoyl, a dimethylcarbamoyl or n-octylcarbamoyl), an alkoxycarbonyl group (preferably having 1 to 20 carbon atoms, such as methoxycarbonyl, ethoxycarbonyl or isopropoxycarbonyl), an aryloxycarbonyl group )preferably having 7 to 20 carbon atoms, such as phenoxycarbonyl, p-methoxyphenoxycarbonyl, m-chaorophenoxycarbonyl or o-methoxyphenoxycarbonyl), an acylamino group (preferably an alkylcarbonylamino group having 1 to 20 carbon atoms, such as formylamino, acetylamino, propionylamino or cyanoacetylamino, an arylcarbonylamino group having 7 to 20 carbon atoms, such as benzoylamino, p-tolylamino, pentafluorobenzoylamino or m-methoxybenzoylamino, or a heterocyclic-carbonylamino group having 4 to 20 carbon atoms, such as 2-pyridylcarbonylamino, 3-pyridylcarbonylamino or furoylamino)an alkoxycarbonylamino group (preferably having 2 to 20 carbon atoms, such as methoxycarbonylamino, ethoxycarbonylamino or methoxyethoxycarbonylamino), an aryloxycarbonylamino group (preferably having 7 to 20 carbon atoms, such as phenoxycarbonylamino, p-methoxyphenoxycarbonylamino, p-methylphenoxycarbonylamino, m-chlorophenoxycarbonylamino or o-chlorophenoxycarbonylamino), a sulfonylamino group (preferably having 1 to 20 carbon atoms, such as methanesulfonylamino, benzenesulfonylamino or toluenesulfonylamino), an aminocarbonylamino group (preferably having 1 to 20, such as methylaminocarbonylamino, ethylaminocarbonylamino, anilinocarbonylamino or dimethylaminocarbonylamino), a sulfamoylamino group (preferably having 1 to 20 carbon atoms, such as methylaminosulfonylamino, ethylaminosulfonylamino or anilinosulfonylamino), an amino group (including an anilino group and preferably 0 to 20 carbon atoms, such as amino, methylamino, dimethylamino, ethylamino, diethylamino, n-butylamino or anilino), an alkoxy group (preferably 1 to 20 carbon atoms, such as methoxy, ethoxy, isopropoxy, n-butoxy or n-dodecyoxy), an aryloxy group (preferably having 6 to 20 carbon atoms, such as phenoxy, m-chlorophenoxy, p-methoxyphenoxy or o-methoxyphenoxy), a silyloxy group (preferably having 3 to 20 carbon atoms, such as trimethylsilyloxy, t-butyldimethylsilyloxy, cetyldimethylsilyloxy or phenyldimethylsilyloxy), a heterocyclic-oxy group [preferably having 3 to 20 carbon atoms, such as tetrahydropiranyloxy, 3-pyridyloxy or 2-(1,3-benzoimidazolyl)oxy] an alkylthio group (preferably having 1 to 20 carbon atoms, such as methylthio, ethylthio, n-butylthio or t-butylthio), an arylthio group (preferably having 3 to 20 carbon atoms, such as phenylthio), a heterocyclic-thio group [preferably having 3 to 20 carbon atoms, such as 2-pyridylthio, 2-(1,3-benzooxazolyl)thio, 1-hexadecyl-1,2,3,4-tetrazolyl-5-thio or 1-(3—N-octadecycarbamoyl)phenyl-1,2,3,4-tetrazolyl-5-thio], a heterocyclic group (preferably having 3 to 20 carbon atoms, such as 2-benzooxazolyl, 2-benzothiazolyl, 1-phenyl-2-benzoimidazolyl, 5-chloro-1-tetrazolyl, 1-pyrrolyl, 2-furanyl, 2-pyridyl or 3-pyridyl), a halogen atom (fluorine, chlorine or bromine), a hydroxy group, a nitro group, a sulfamoyl group (preferably having 0 to 20 carbon atoms, such as methylsulfamoyl or dimethylsuifamoyl), a sulfonyl group (preferably having 1 to 20 carbon atoms, such as methanesulfonyl, benzenesulfonyl or toluenesulfonyl), an azo group (preferably having 3 to 20 carbon atoms, such as p-nitrophenylazo), an acyloxy group (preferably having 1 to 20 carbon atoms, such as formyloxy, acetyloxy or benzoyloxy), a carbamoyloxy group (preferably having 1 to 20 carbon atoms, such as methylcarbamoyloxy or diethylcarbamoyloxy), an imido group (preferably having 4 to 20 carbon atoms, such as succinimido or phthalimido), a. sulfinyl group (preferably having 3 to 20 carbon atoms, such as diethylaminosulfinyl), a phospholyl group(preferably having 0 to 20 carbon atoms, such as diaminophospholyl) and an azolyl group (preferably having 2 to 20 carbon atoms, such as 3-pyrazolyl).

Exemplary examples of the compounds represented by formulas (I) to (VII) are shown below, but the invention is not limited to these.

I-1

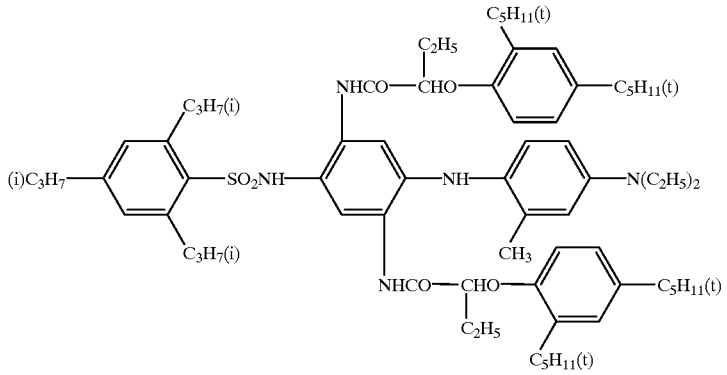

-continued
I-2
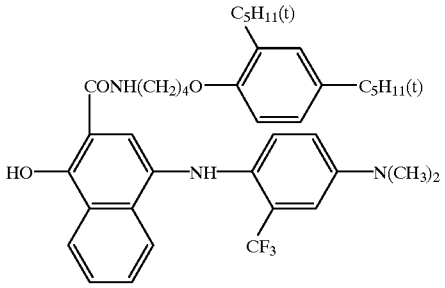
I-3
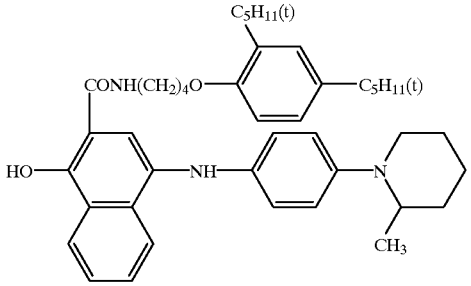
I-4
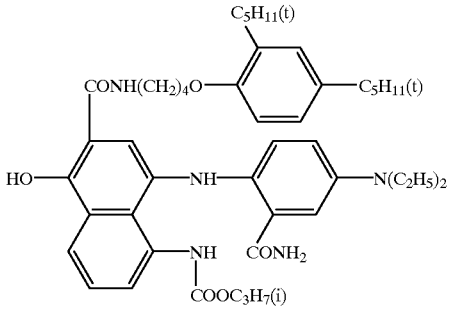
I-5
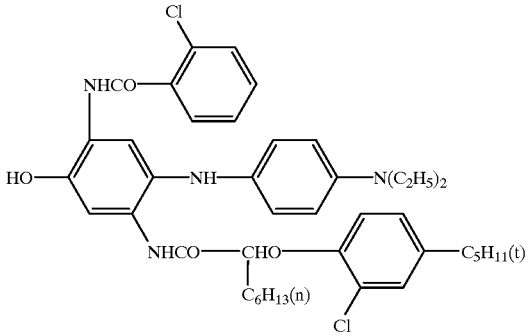
I-6
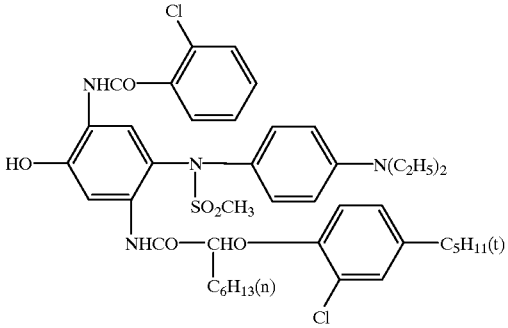

-continued
I-7
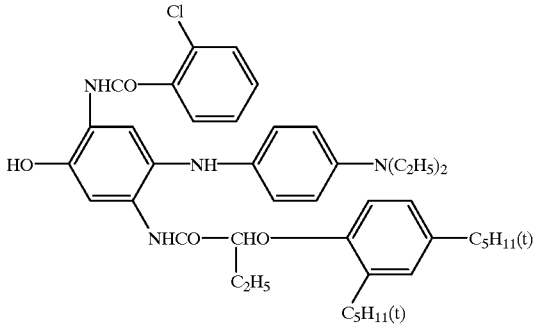
I-8
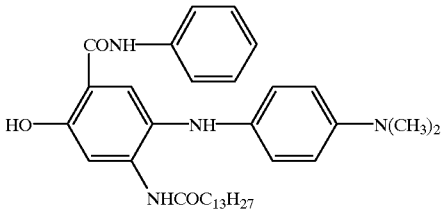
I-9
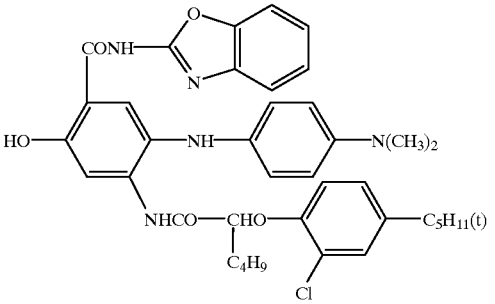
I-10
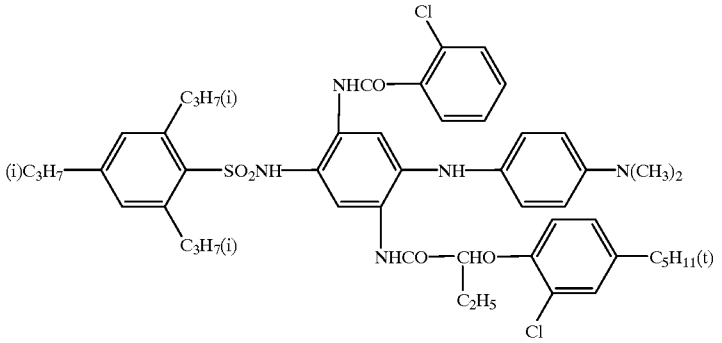
I-11
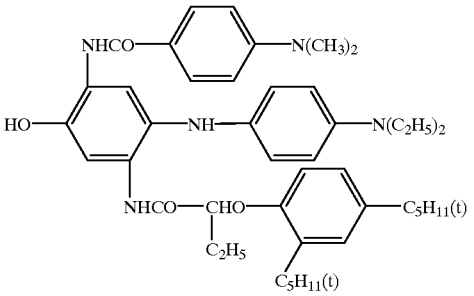

-continued
I-12
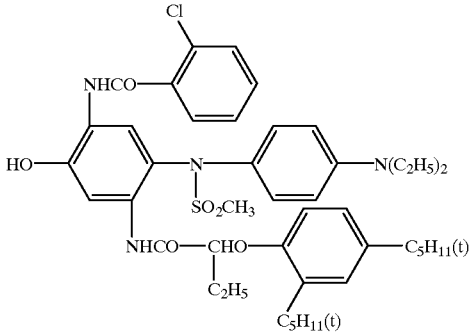
II-1
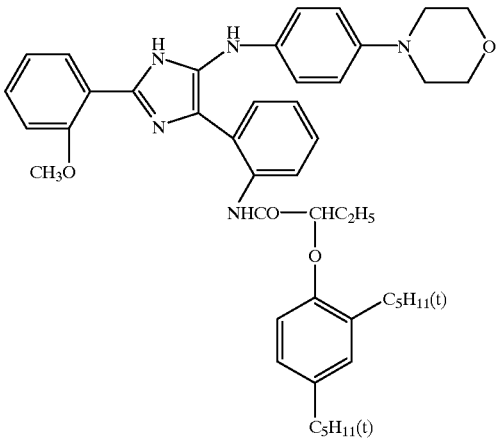
II-2
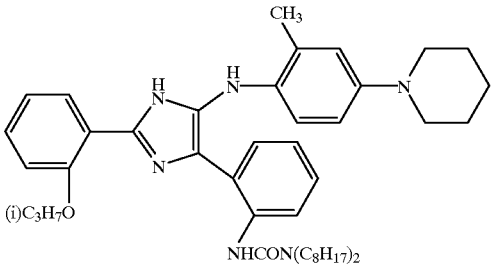
II-3
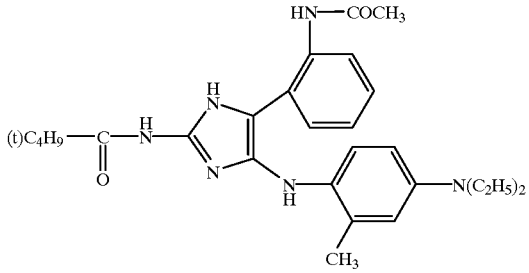

-continued
II-4
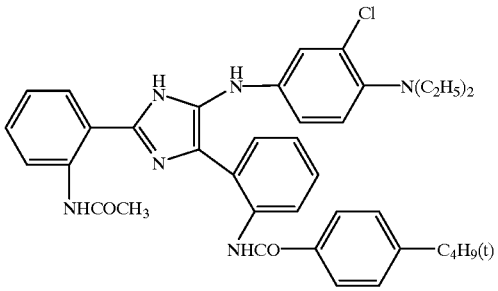
II-5
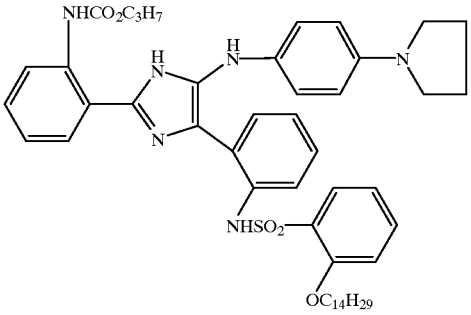
II-6
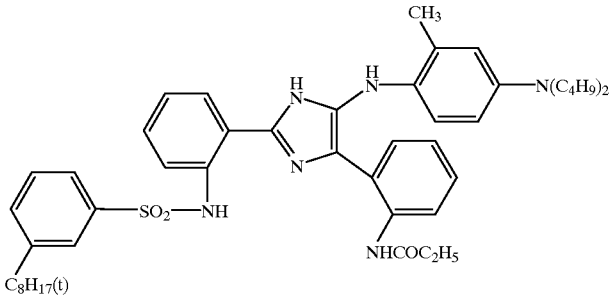
III-1
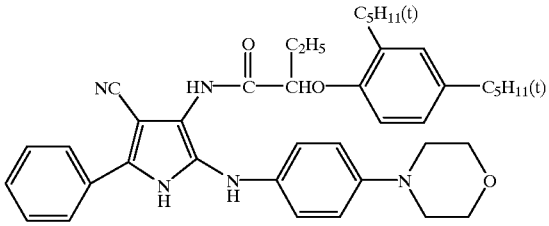
III-2
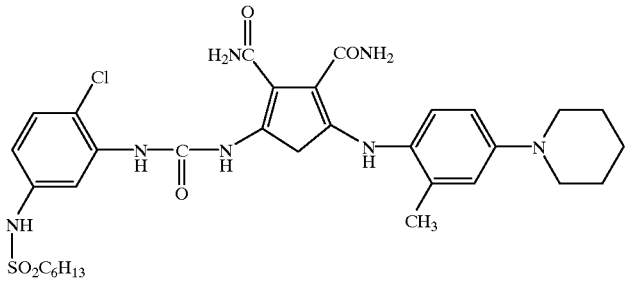

-continued
III-3
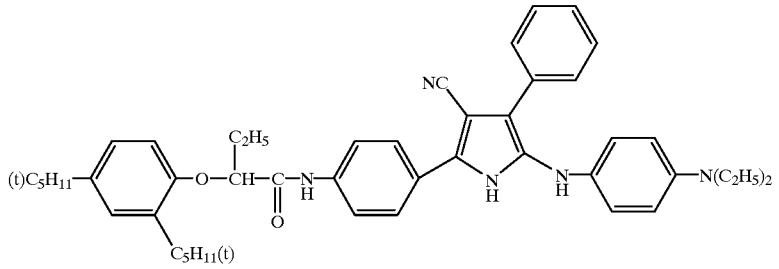
III-4
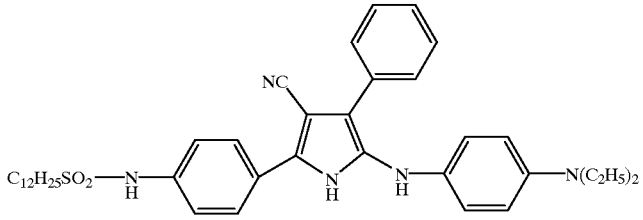
III-5
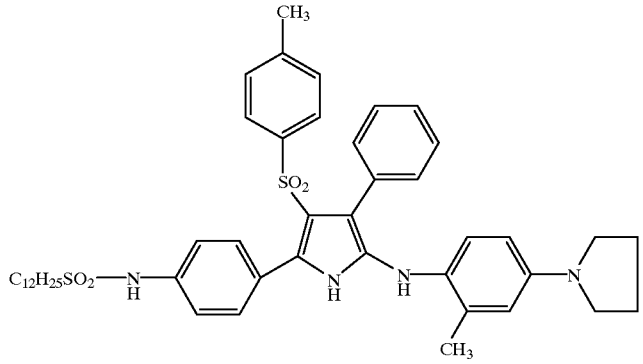
III-6
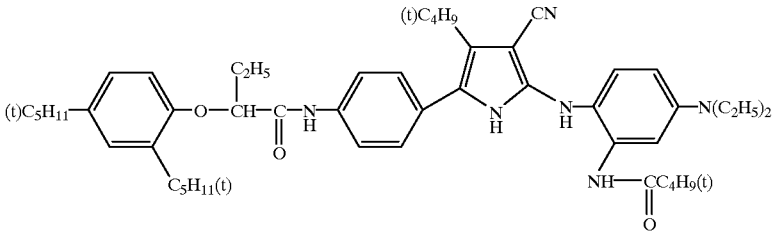
IV-1
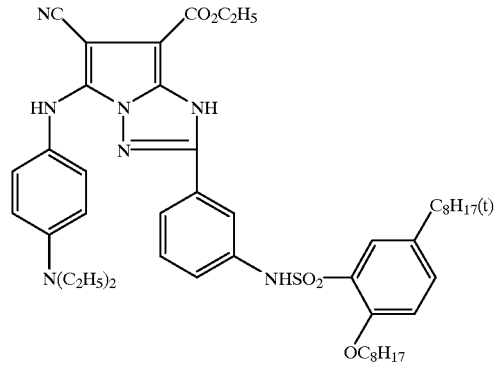

-continued
IV-2
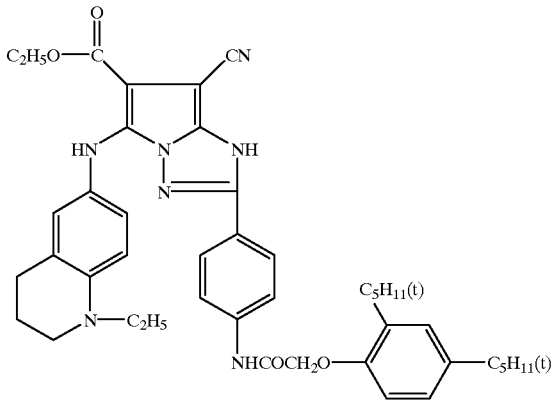
IV-3
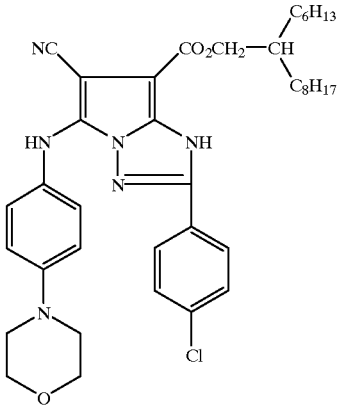
IV-4
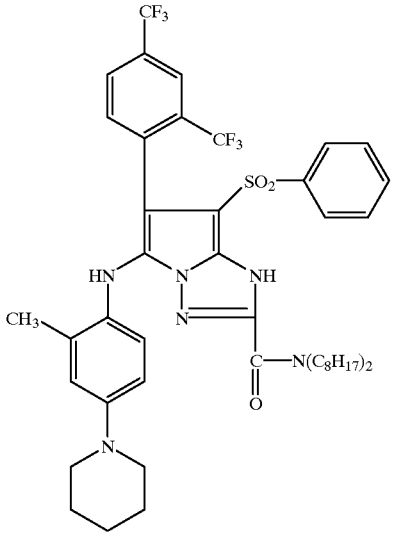

-continued

V-1

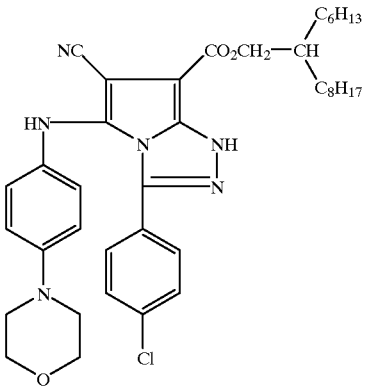

V-2

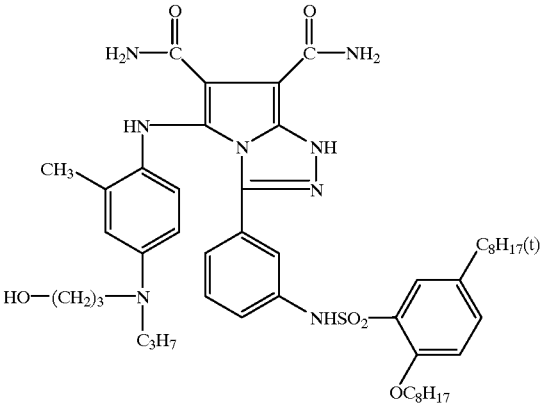

VI-1

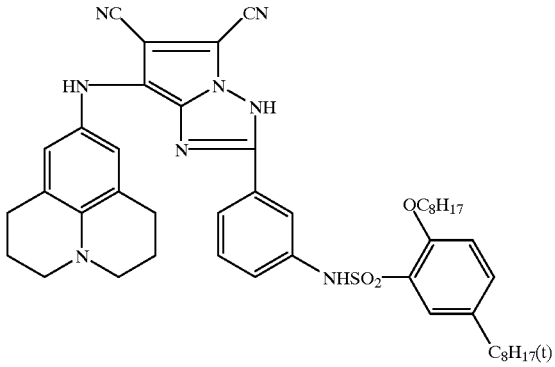

VII-1

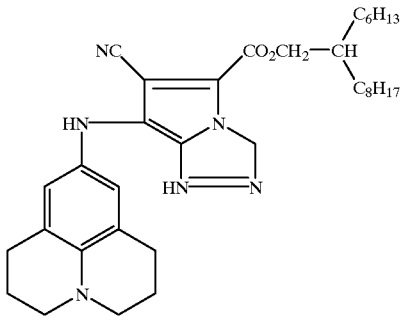

The leuco compound used in the invention is preferably incorporated in an amount of $1\times10^{-6}$ to $5\times10^{-2}$ mol and more preferably $1\times10^{-5}$ to $2\times10^{-2}$ mol per mol of silver halide. The leuco compound can be dissolved in a water-miscible organic solvent, such as alcohols )e.g., methanol, ethanol, fluorinated alcohol), ketones (e.g., acetone, methyl ethyl ketone), dimethylformamide, dirmethylsulfoxide, and methyl cellosolve. According to the well known emulsifying-dispersion method, the leuco compound can be dissolved employing an oil such as dibutyl phthalate, tricresyl phthalate, glyceryl triacetate or diethyl phthalate and optionally employing an auxiliary solvent such as ethyl acetate or cyclohexane, and mechanically dispersed. Alternatively, according to the method known as a solid dispersing method, the leuco compound in the form of powder is dispersed in water by a ball mil, colloid mill or ultrasonic homogenizer.

The leuco compound capable of forming a blue dye upon reaction with an oxidation product of a developing agent can be incorporated into a silver halide emulsion layer or a hydrophilic colloidal layer adjacent thereto. The compound can be added to the emulsion at any time during the course of preparing the photographic material, and preferably at a time after completing chemical ripening and before coating.

In the invention, 50 to 100% of the projected area of silver halide grains contained in the emulsion layer is accounted for by tabular grains having a silver chloride content of 50 to 100 mol %, (100) major faces, and an aspect ratio of 2 to 15 (hereinafter, sometimes referred to as tabular silver halide grains of the invention). The tabular silver halide grains refer to grains having two major faces which are parallel and opposite to each other and the ratio of grain diameter to grain thickness (hereinafter, referred to as aspect ratio) of 2 or more. The grain diameter refers to a diameter of a grain projected area, that is, a circle equivalent diameter of the projected area of the tabular silver halide grain. (Herein, the circle equivalent diameter is referred to a diameter of the circle with an area equivalent to the grain projected area.) The grain thickness refers to a distance between two parallel major faces of the tabular silver halide grain.

The tabular silver halide grains of the invention have an aspect ratio of 2 or more, preferably 2 to 15 and more preferably 5 to 10. The tabular grains having (100) major faces account for 50% or more, preferably 70% or more and more preferably 90% or more of the total grain projected area of the emulsion layer, and the tabular grains having a silver chloride content of 50 mol % or more, preferably 70 mol % or more , and more preferably 90 to 100 mol %.

In the invention, the major face of the tabular silver halide grains is in the form of a rectangle (i.e., right-angled parallelogram) or one with rounded corners. The edge ratio of the rectangle (i.e., ratio of the long edge length to the short edge length) is preferably 1 to 2, more preferably 1 to 1.5 and still more preferably 1 to 1.2. In cases where the corner is rounded, the edge length is defined as the distance between the intersection of an extended straight line of the edge and extended straight lines of adjacent edges.

An average grain diameter of the tabular silver halide grains of the invention is preferably 0.15 to 5.0 $\mu$m, more preferably 0.4 to 3.0 $\mu$ and furthermore preferably 0.4 to 2.0 $\mu$m. An average thickness of the tabular silver halide grains is preferably 0.01 to 1.0 $\mu$m, more preferably 0.02 to 0.40 $\mu$m and furthermore preferably 0.02 to 0.30 $\mu$m.

The grain diameter and thickness can be optimized so as make best sensitivity and other photographic characteristics. The optimal grain diameter and thickness depend upon sensitivity and other factors affecting photographic characteristics (thickness of a hydrophilic colloidal layer, hardening degree, chemical ripening conditions, designed speed of a photographic material, silver coating amount, etc.).

The tabular silver halide grains used in the invention are preferably monodisperse grains having a narrow grain size distribution. Thus, a width of grain size (diameter) distribution, defined as below, is preferably 25% or less, more preferably 20% or less and furthermore preferably 15% or less.

Width of grain size distribution (%)=(standard deviation of grain size/average grain size)×100

The tabular silver halide grains used in the invention are preferably those having a narrow grain thickness distribution. Thus, a width of grain thickness distribution, defined as below, is preferably 25% or less, more preferably 20% or less and furthermore preferably 15% or less.

Width of grain thickness distribution (%)=(standard deviation of grain thickness/average grain thickness)×100

The silver iodide content of the tabular silver halide grains used in the invention is, in terms of an average value of the overall silver iodide content, preferably 3.0 mol % or less and more preferably 1.0 mol % or less. The silver iodide content of the tabular grains of silver halide grains can be determined by the EPMA method (Electron Probe Micro Analyzer method). Thus, a sample in which silver halide grains are dispersed so as not to contact with each other, is prepared and an electron-beam is employed to irradiate the sample to analyze X-rays due to electron beam excitation, whereby elemental analysis of a micro-spot can be achieved. According to this method, characteristic X-ray intensities of silver and iodine radiated from the grain are measured to determine the halide composition of the grain. An average silver iodide content can be determined by measuring the silver iodide content of at least 50 grains employing the EPMA method.

In the tabular silver halide grains used in the invention, iodide contents among grains are preferably uniform. When the iodide contents among the grains are determined by the EPMA method, a relative standard deviation (i.e., coefficient of variation of the iodide content of grains) is preferably 35% or less and more preferably 20% or less.

In cases where the tabular silver halide grains contain iodide, the iodide is preferably, internally contained. In this case, the iodide is contained more preferably in the central portion of the grain. It is also preferable that the iodide is made present in the surface portion of the grain.

The halide composition within a silver halide grain can be determined by cutting ultra-thinly slices from the grain and making observation and analysis of the grain by a transmission electron microscope with cooling. Thus, after silver halide grains are taken out from an emulsion, the grains are buried in a resin, which is cut at a thickness of ca. 60 nm with a diamond knife to prepare a slice sample. With cooling with liquid nitrogen, the slice sample is observed and analyzed at various points with a transmission electron microscope provided with an energy-dispersion type X-ray analyzing apparatus to determine the halide composition within the grain. (Inoue & Nagasawa, Abstracts of Annual Meeting of The Society of Photographic Science and Technology of Japan, 1987, page 62.) The iodide content in the surface of the tabular silver halide grains refers to a silver iodide content of a portion in a depth from the surface of 50 nm, which can be determined by the XPS method (X-ray Photoelectron Spectroscopy). Thus, a sample is cooled to −110° C. in super-vacuo of not more than $1\times10^{-8}$ torr and exposed to MgK $\alpha$-line, as X-ray for probe, at 15 kV for the X-ray source voltage and 40 mA for the X-ray source current to make measurement with respect to Ag3d5/2, Br3d and I3d3/2 electrons. Measured integral intensity of each peak is corrected with a sensitivity factor and from their intensity ratio, the halide composition of the surface can be determined. By cooling the sample, measurement errors resulted from destruction of the sample (i.e., decomposition of silver halide and diffusion of halide, specifically, iodide) when exposed to X-ray at room temperature are minimized, resulting in enhanced measurement accuracy. When cooled down to −110° C., sample destruction is minimized to a level which prevents problems in measurement.

The tabular silver halide grains used in the invention may have dislocation lines. The dislocation lines can be directly observed by use of a transmission type electron microscope at low temperature, as described in J. F. Hamilton, Phot. Sci. Eng., 57 (1967) and T. Shiozawa, J. Soc. Phot. Sci. Japan, 35, 213 (1972). Thus, silver halide grains, which are carefully taken out from an emulsion without applying pressure to an extent of causing dislocation, are placed on a mesh for electron microscopic observation and observed by the transmission method, while being cooled to avoid damage due to electron beam. In this case, the more is the grain thickness, the less the transmission of the electron beam, so that clearer observation is achieved by use of a high voltage type electron microscope.

The tabular silver halide grains usable in the invention can be prepared according to the method described in U.S. Pat. No. 5,320,938. Thus, it is preferred to form nucleus grains in the presence of iodide ions at a low pC1 under such conditions as to easily form (100) face. After nucleation, Ostwald ripening and/or growing are carried out to obtain tabular silver halide grains with desired size and size-distribution. To a first reaction vessel, for example, are added a silver salt aqueous solution, a halide aqueous solution containing iodide and a protective colloid solution to form nucleus grains and after completing nucleation, the reaction mixture is transferred to a second vessel, in which grain growth is preferably performed. Alternatively, the growth is allowed to be interrupted and the resulting grains are employed as seed grains to further grow the seed grains by depositing thereon silver halide. Concretely, to a reaction vessel containing an aqueous protective colloid solution and seed grains are supplied silver ions, halide ions and optionally fine silver halide grains to grow the seed grains.

In preparation of the tabular silver halide grains, the pC1 of a protective colloidal solution is preferably 0.5 to 3.5 and more preferably 1.0 to 3.0 and furthermore preferably 1.5 to 2.5. In the course of preparing the tabular silver halide grains, nucleation starts at the time a silver salt solution is added to a protective colloidal solution, wherein iodide ions are preferably added concurrently with or prior to addition of the silver salt solution, and more preferably prior to addition of the silver salt solution.

Iodide ions can be introduced up to the limit of solid solution of silver iodide. The iodide ion concentration in a protective colloidal solution at the start of nucleation is preferably 10 mol % or less, more preferably 0.01 to 10 mol % and furthermore preferably 0.05 to 10 mol %. The adding time of a silver salt solution at the nucleation is preferably not less than 5 sec. and less than 1 min. It is preferred to concurrently add a silver salt solution and a halide solution at the nucleation. It is also preferred to add iodide ions at the nucleation. So long as 50 mol % or more chloride ions are present, bromide ions may be present in the protective colloidal solution at the nucleation. In the invention, the chloride content of nucleus grains is preferably 50 mol % or more, more preferably 70 mol % or more and furthermore preferably 90 mol % or more. The pH at the time of nucleation is preferably 2 to 8. The temperature is preferably 30 to 90° C. and more preferably 35 to 70° C. The silver amount to be added at the nucleation is preferably 0.1 to 10 mol % of the total silver amount. Ammonia, thioethers, thioureas may be made present in the process of preparing the tabular silver halide grains used in the invention.

In the process of growing grains, a silver salt solution and a halide solution are preferably added by the double jet method at an accelerated flow rate without causing to form nucleus grains and widen the grain-size distribution, i.e., by gradually increasing the flow rate within the range of 30 to 100% of the rate of forming new nucleus grains in proportion to grain growth to obtain final grains with desired size and grain size distribution. Alternatively, there is preferably employed a method of supplying fine silver halide grains, which are dissolved and recrystalize to grow grains, as described in Abstracts of Annual meeting of the Society of Photographic Science and technology of Japan (1983) at page 88. In this case, there are preferably employed fine silver iodide grains, fine silver bromide grains, fine silver iodobromide grains, and fine silver chloride grains.

The tabular silver halide grains usable in the invention may be so-called halide-converted type (conversion type) grains. The halide-converted amount is preferably 0.2 to 0.5 mol %, based on silver. The halide conversion can be conducted, during physical ripening or after completing physical ripening, by adding a solution of halide, the solubility product of a silver salt of which is less than that of the halide composition of the grain surface prior to conversion, or fine silver halide grains. In this case, the size of the fine silver halide grains is preferably 0.2 $\mu$m or less and more preferably 0.02 to 0.1 $\mu$m.

Techniques for allowing silver iodide and/or silver bromide to be contained in the outermost surface of the tabular silver halide grains include simultaneous addition of a silver nitrate solution and a solution containing iodide and/or bromide ions to an emulsion containing the tabular grain as substrate; addition of fine silver halide grains such as silver iodide, silver bromide, silver iodobromide or silver iodochlorobromide; and addition of potassium iodide, or a mixture of potassium iodide and potassium bromide. Of these is preferred addition of fine silver iodide grains, fine silver bromide grains or fine silver iodobromide grains.

The time for adjusting the iodide content and/or bromide content of the outermost surface is from the final step of preparing silver halide crystal grains, through chemical ripening, to the process of preparing a coating solution immediately before coating. Specifically, it is preferred to make adjustment before completing chemical ripening process. Herein, chemical ripening process is referred to as a period from the time of completing physical ripening and desalting of a silver halide emulsion to the time of adding a chemical sensitizer and subsequently making treatment for stopping the chemical ripening. Fine grains may be separately added at time intervals, and after adding fine grains, there may be added another chemically ripened emulsion. When the fine grains are added, the temperature of the emulsion is preferably maintained within a range of 30 to 80° C., and more preferably 40 to 65° C. Fine grains are preferably added under such conditions that a part or all of the fine grains disappear until immediately before coating and more preferably at least 20% of the fine grains disappear immediately before coating.

In cases where silver bromide is allowed to be contained in the outermost surface of the tabular silver halide grains used in the invention, techniques are addition of a silver nitrate solution and a bromide ion-containing solution, and addition of fine silver bromide grains. Of these is preferred addition of fine silver bromide grains. In this case, iodide and/or chloride may be contained. Specifically in the case of iodide, there can employed a compound capable of providing an iodide ion.

In the tabular silver halide grains used in the invention, when the bromide is localized in the vicinity of the grain surface, the silver bromide content in the vicinity of the surface is preferably 20 mol % or more and more preferably 50 mol % or more. When the iodide is localized in the vicinity of the grain surface, the silver iodide content therein is 5 mol % or less and more preferably 1 mol % or less. Herein, the term, "the vicinity of the grain surface" means a portion in a depth from the outermost surface of 1/5 of the grain size and preferably 1/7 of the grain size.

In the invention, the vicinity of the corner of a grain means a portion included in a distance of from the corner to about 1/3 of a circle equivalent diameter of the grain. To form a localized phase in the vicinity of the corner, there is preferably employed a technique in which a compound capable of being adsorbed selectively onto (100) faces is allowed to be adsorbed to the grain surface to retard or inhibit halide conversion. Examples of such a compound include cyanine dyes, merocyanine dyes, mercaptoazoles and purines. When a localized phase is formed in the vicinity of the corner, pressure desensitization is liable to occur, but it is not observed in the invention. It is contemplated to be inherent to the tabular grains having (100) major faces and it is unexpected results.

In preparing the tabular silver halide grains is very important stirring conditions in forming silver halide grains. A stirring apparatus described in JP-A 62-160128 is preferably employed, in which a liquid-adding nozzle is provided within the reaction mother liquor, specifically, in the vicinity of an inlet for the mother liquor. In this case, stirring rotation speed is preferably 100 to 1200 rpm.

In a process of nucleation and/or growth of the tabular silver halide grains is preferably added a metal ion, using at least one selected from the group consisting of a cadmium salt, zinc salt, lead salt, thallium salt, iridium salt (including a complex salt), rhodium salt (including a complex salt) and iron salt (including a complex salt), to allow the metal to be included in the interior of the grain and/or in the surface of the grain.

It is preferred to add a solvent for silver halide before desalting. A thiocyanate compound (such as potassium thiocyanate, sodium thiocyanate and ammonium thiocyanate), for example, is added preferably in an amount of $1\times10^{-3}$ to $3\times10^{-2}$ mol per mol of silver halide.

As a protective colloidal medium used for dispersing silver halide grains is preferably employed gelatin. Examples of the gelatin include alkali-process gelatin, acid process gelatin, low molecular weight gelatin (molecular weight, 20,000 to 100,000) and modified gelatin such as phthalated gelatin. Besides gelatin, other hydrophilic colloids can be employed. Examples thereof are described in research Disclosure (hereinafter, denoted as RD) vol. 176, No. 17643 (December, 1978).

In preparation of the taoular silver halide grains, unnecessary soluble salts may be removed during grain growth or may be kept contained. Removal of salts can be conducted based on the method described in RD 17643.

The tabular silver halide grains can be subjected to chemical sensitization. There is specifically no limitation with respect to conditions of chemical ripening or chemical sensitization, such as pH, pAg, temperature and time, and chemical sensitization can be conducted under conditions known in the art. A selenium sensitizing method by use of a selenium compound and tellurium sensitizing method by use of a tellurium compound can be employed.

Various kinds of selenium compound known in the art can be employed, as a selenium sensitizer, in selenium sensitization. Examples thereof include colloidal selenium metal, isocyanates (e.g., allyl isocyanate, etc.), selenoureas (e.g., N,N-dimethylselenourea, N,N,N'-triethylselenourea, N,N,N'-trimethyl-N'-heptafluoropropylcarbonylselenourea, N,N,N'-trimethyl-N'-nitrophenylcarbonylselenourea, etc.), selenoketones (e.g., selenoacetone, selenoacetophenone, etc.), selenoamides, (e.g., selenoacetoamide, N,N-dimethylselenobenzamide, etc.), selenocarboxylic acids and selenoesters (e.g., 2-selenopropionic acid, methyl-3-selenobutylate, etc.), selenophosphates (e.g., tri-p-triselenophosphate, etc.), and selenides (e.g., triphenylphosphineselenide, diethylselenide, diethyldiselenide, etc.). Of these, selenoureas, selenoamides, selenoketones and selenides are preferred. The amount of the selenium sensitizer to be used depends on a selenium compound, silver halide grains or chemical-ripening conditions, and is generally $1\times10^{-8}$ to $1\times10^{-4}$ mol per mol of silver halide. The selenium compound may be incorporated through solution in water or an organic solvent such as methanol or ethanol, alone or in combination, according to propertied of the compound. Alternatively, the selenium may be incorporated in a manner such that it is previously mixed with a gelatin aqueous solution or emulsion-dispersed in a mixture solution of an organic solvent-soluble polymer. The chemical ripening with a selenium sensitizer is preferably conducted at a temperature of 40 to 90° C. and more preferably 45 to 80° C. The pH and pAg thereof are 4 to 9 and 6 to 9.5, respectively.

Various kinds of tellurium compound known in the art can be employed, as a tellurium sensitizer, in tellurium sensitization. Examples thereof include telluroureas (e.g., N,N-dimethyltellurourea, tetramethyltellurourea, N-carboxyethyl-N,N'-dimethyltellurourea, N,N'-dimethyl-N'-phenyltellurourea), phosphinetellurides (e.g., tributylphosphinetelluride, tricyclohexylphosphinetelluride, triisopropylphosphinetelluride, butyldiisopropylphosphinetelluride, dibutylphenylphosphinetelluride), telluroamides (e.g., telluroacetoamide, N,N-dimethyltellurobenzamide), telluroketones, telluroesters and isotellurocyanates. The tellurium sensitizer can be employed in a manner similar to the selenium sensitized above described.

The above described selenium sensitization and tellurium sensitization can be conducted in combination with gold sensitization or sulfur sensitization known in the art.

The tabular silver halide grains can be spectrally sensitized with methine dyes or others. Examples dye employed include cyanines, merocyanines, complex cyanines, complex merocyanines, holopolar cyanines, styryl dyes and hemioxonol dyes. Of these dyes, useful dyes are cyanine dyes, merocyanine dyes and complex merocyanine dyes. The sensitizing dye can be added at any time in the process of nucleation, growth, desalting and chemical sensitization, at a time between the processes, or at a time after completing chemical sensitization.

The silver halide light sensitive photographic material of the invention can be processed with processing solutions, as described in RD-17643, XX–XXI, page 29–30 and RD-308119, XX–XXI, page 1011–1012.

Dihydroxybenzenes (e.g., hydroquinone), 3-pyrazolidones (e.g., 1-phenyl-3-pyrazolidone) aminophenols (e.g., N-methyl-p-aminophenol) can be employed as a black-and-white developing agent, singly or in combination thereof. In a developing solution is optionally employed a preservative, alkali agent, pH buffering agent, fog inhibitor, hardener, development accelerating agent, surfactant, defoaming agent, water-softening agent, dissolving aid, and thickening agent. In a fixing solution is employed a thiosulfate or thiocyanate, as a fixing agent. Further thereto, water soluble aluminum salts such as aluminum sulfate and potassium alum are employed as a hardening agent. Furthermore, a preservative, pH adjusting agent and water-softening agent may be contained.

The photographic material of the invention can be processed using an automatic processor. The processing time of from developing to drying, i.e., a period of from the time a top of the photographic material is dipped into a developing solution, through processing steps, to the time the top is taken out from a drying zone (so-called Dry to Dry time) is preferably 10 to 45 sec. and more preferably with 30 sec. The developing temperature is preferably 25 to 50° C. and more preferably 30 to 40° C. The fixing temperature and time are preferably 20 to 50° C. and 6 to 20 sec., and more preferably 30 to 40 k C and 6 to 15 sec., respectively. The drying temperature is conventionally 35 to 100° C. and preferably 40 to 80° C. In the processor, there may be provided a drying zone, in which hot air is blown or a heating means by far-infrared radiation is provided. There may be employed a processor having mechanism of supplying acidic rinsing solution between the steps of developing, fixing and washing. Furthermore, an apparatus for preparing a developing solution or fixing solution may be built in the processor. The replenishing rate of a developing solution or fixing solution is preferably 200 ml or less and more preferably 30 to 150 ml per $m^2$ of film. According to the invention, even when processed at a low replenishing rate, there is not observed deterioration of photographic performance.

EXAMPLES

The present invention will be further explained based on examples.

Example 1

Preparation of emulsion Em-1

To a reaction vessel was added 1200 ml of a gelatin aqueous solution (containing 18 g of deionized alkali-process gelatin having a methionine content of about 40 μmol/g and pH of 4.3), and further thereto were simultaneously added Ag-1 solution (containing 20 g of $AgNO_3$, 0.8 g of the above gelatin and 0.2 ml of 1N $HNO_3$ solution per 100 ml) and X-1 solution (containing 6.9 g of NaCl, 0.8 g of the gelatin and 0.3 ml of 1N NaOH solution per 100 ml), each 12 ml at a flow rate of 24 ml/min, while being maintained at 43° C. After stirred for 2 min. were simultaneously added Ag-2 solution (containing 2 g of $AgNO_3$, 0.8 g of the above gelatin and 0.2 ml of 1N $HNO_3$ solution per 100 ml) and X-2 solution (containing 1.4 g of KBr, 0.8 g of the gelatin and 0.3 ml of 1N NaOH solution per 100 ml), each 19 ml at a flow rate of 31 ml/min. After stirred for 2 min. were added Ag-i solution and X-1 solution, each 36 ml at a flow rate of 48 ml/min. Further thereto, 20 ml of NaCl solution (containing 10 g of NaCl per 100 ml) was added, and the pH and temperature were adjusted to 4.8 and 75° C., respectively. After ripened for 20 min., the pH was changed to 5.0 and the temperature was lowered to 60° C., and 400 ml of Ag-3 solution (containing 10 g of $AgNO_3$ per 100 ml) and X-3 solution (containing 3.6 g of NaCl per 100 ml) were added by the controlled double jet method at an accelerated flow rate (7 ml/min. at the start and accelerated by 0.1 ml/min.), while the silver potential was maintained at 100 mV. Then, AgI fine grains with an average sphere equivalent diameter of 0.03 μm were added in an amount of 0.2% per mol of silver halide and ripening were further continued for 5 min. to complete halide conversion. A coagulant was added thereto, the temperature was lowered to 30° C. and coagulation washing was carried out. Thereafter, a gelatin aqueous solution was added and the pH and pC1 were each adjusted to 6.2 and 3.0, respectively.

As a result of observation of transmission electron micrograph of replica of silver halide grains takes out from the emulsion prepared, characteristic values regarding the grain shape were shown as below.

Total projected are of tabular grains with an aspect ratio of 2 or more and (100) major faces/ Sum of projected area of total grains=$a_1$=0.91

Average aspect ratio of tabular grains with an aspect ratio of 2 or more and (100) major faces (average diameter/ average thickness)=$a_2$=4.5

Total projected are of tabular grains with an aspect ratio of 2 or more, (100) major faces and a edge ratio of 1 to 2.0/ Sum of projected area of total grains=$a_3$=0.97

The silver chloride content of emulsion Em-1 was 99 mol %. Preparation of emulsions Em-2 and Em-3

Emulsions Em-2 and Em-3 were each prepared in the same manner as in Em-1, except that NaCl in X-3 solution was replaced by KBr and the silver potential was varied so as to have a silver chloride content of 60 mol % (Em-2) or 40 mol % (Em-3). The shape and characteristic values of silver halide grains of Em-2 and Em-3 were the same as those of Em-1.

Preparation of emulsions Em-4 to 7

Emulsions Em-4 to 7 were each prepared in the same manner as in Em-1, except that the silver potential, pH and flow rate were optimally varied. Characteristic values of silver halide grains of each of the resulting emulsions were as follows.

| | | | |
|---|---|---|---|
| Em-4: | $a_1$ = 0.95 | $a_2$ = 9.5 | $a_3$ = 0.90 |
| Em-5: | $a_1$ = 0.90 | $a_2$ = 4.5 | $a_3$ = 0.40 |
| Em-6: | $a_1$ = 0.90 | $a_2$ = 4.5 | $a_3$ = 0.60 |
| Em-7: | $a_1$ = 0.30 | $a_2$ = 2.2 | $a_3$ = 0.99 |

Emulsions Em-1 to 7 were each kept at 56° C. with stirring and chemically sensitized according to the following manner. Thus, a thiosulfonic acid compound ($C_2H_5SO_2SNa$) was added, then, thiourea dioxide was added and ripening was continued further for 20 min to perform reduction sensitization. Next, 4-hydroxy-6-methyl-1,3,3a,7-tetraazaindene and the following spectral sensitizing dyes A and B were each added in an optimal amount. Subsequently, sodium thiosulfate and triphenylphosphine selenide were added thereto and chloroauric acid and potassium thiocyanate were further added, and after 40 min., the emulsion was cooled. The amount of each additive was optimally varied so as to perform optimal sensitization.

To each of the resulting emulsions, additives as shown below were added to prepare an emulsion coating solution. A coating solution for a protective layer was also prepared. Samples 1 to 12 were prepared by coating both coating solutions on both sides of a support using two slide hopper type coating machines so as to have 1.6 g of silver coverage and 2.2 g of a gelatin coating amount per $m^2$ of each side. The support was a polyethylene terephthalate base with a thickness of 175 μm (tinted with a blue density of 0.15 and used for X-ray film) which was subbed by coating an aqueous dispersion of a copolymer latex comprised of monomers of glycidyl methacrylate (50 wt. %), methyl acrylate (10 wt. %) and butyl methacylate (40 wt. %).

(A) 5,5'-Dichloro-9-ethyl-3,3'-di-(3-sulfopropyl) oxacarbocyanine sodium salt (B) 5,5'-Di-(butoxycarbonyl)-1,1'-di-ethyl--3,3'-di-(4-sulfobutyl)benzoimidazolocarbocyanine sodium salt The coating solution for emulsion layer was prepared by adding, to each of prepared emulsions, the following additives, provided that the adding amount was per mol of silver halide.

| | |
|---|---|
| 1,1-Dimethylol-1-nitromethane | 70 mg |
| t-Butylcatechol | 400 mg |
| Polyvinylpyrrolidone (M.W. 10,000) | 1.0 g |
| Styrene-maleic acid copolymer | 2.5 g |
| Nitrophenyl-triphenylphosphonium chloride | 50 mg |
| Ammonium 1,3-dihydroxybenzene-4-sulfonate | 2 g |
| $C_4H_9OCH_2CH(OH)CH_2N(CH_2COCH)_2$ | 1 g |
| 1-Phenyl-5-mercaptotetrazole | 15 mg |
| n-$C_4H_9OCH_2CH(OH)CH_2N(CH_2COOH)_2$ | 1 g |
| Dextrane (M.W. 39,000) | 20.0 g |
| Leuco compound as shown in Table 1 | |
| 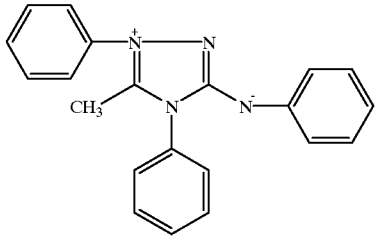 | 150 mg |
| 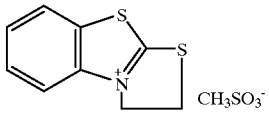 | 70 mg |

The coating solution was prepared by adding the following additives, provided that the amount was per liter of coating solution.

| | |
|---|---|
| Lime-processed gelatin | 68 g |
| Acid process gelatin | 2 g |
| Sodium iso-amyl-n-decylsulfosuccinate | 1 g |
| Polymethyl methacrylate (matting agent with area-averaged diameter of 3.5 μm) | 1.1 g |
| Silicon dioxide (matting agent with area-averaged diameter of 1.2 μm) | 0.5 g |
| $(CH_2{=}CHSO_2CH_2)_2O$ | 7 mg |
| $C_4F_9SO_3K$ | 2 mg |
| $C_{12}H_{25}CONH(CH_2CH_2O)_5H$ | 2.0 g |
| 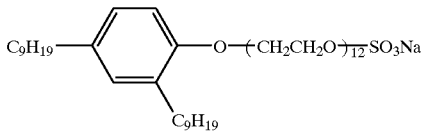 | 1.0 g |
| 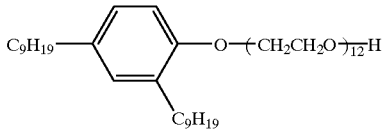 | 0.4 g |
| 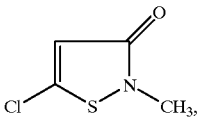 | 0.1 g |

-continued

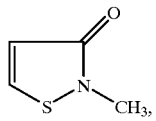

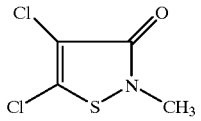

(50:46:4)

Processing solutions and processing steps are as follow. Developer composition (to make up 12 liters)

| | |
|---|---|
| Part A | |
| Potassium hydroxide | 450 g |
| Potassium sulfite (50% aq. solution) | 2280 g |
| Diethylenetriaminepentaacetic acid | 120 g |
| Sodium bicarbonate | 132 g |
| 5-Methylbenzotriazole | 120 mg |
| 1-phenyl-5-mercaptotetrazole | 200 mg |
| Hydroquinone | 340 g |
| Water to make | 5000 ml |
| Part B | |
| Glacial acetic acid | 170 g |
| Triethylene glycol | 185 g |
| 1-Phenyl-3-pyrazolidone | 22 g |
| 5-Nitroindazole | 0.4 g |
| Starter | |
| Glacial acetic acid | 120 g |
| KBr | 225 g |
| Water to make | 1 liter |

To 5 liters of water were simultaneously added Parts A and B, and with stirring, water was further added to make up to 12 liters. The pH was adjusted to 10.40 with glacial acetic acid. The resulting developer solution was used as a developer replenishing solution. To 1 liter of the replenishing solution was 20 ml of Starter and the pH was adjusted to 10.26. This solution was used as a developer working solution. Fixer composition (to make up 18 liters)

| | |
|---|---|
| Part A | |
| Ammonium thiosulfate (70 wt./vol. %) | 6000 g |
| Sodium sulfite | 110 g |
| Sodium acetate trihydrate | 450 g |
| Sodium citrate | 50 g |
| Gluconic acid | 70 g |
| 1-(N,N-dimethylamino)-1-ethyl-5-mercaptotetrazole | 18 g |
| Part B | |
| Aluminum sulfate | 800 g |

To 5 liters of water were simultaneously added Parts A and B, and with stirring, water was further added to make up to 18 liters. The pH was adjusted to 4.40 with sulfuric acid and NaOH to prepare a fixing solution. This fixing solution was also used as a replenishing solution. Processing step

| Step | Temperature (°C.) | Time |
|---|---|---|
| Developing + cross-over | 35 | 7.8 |
| Fixing + cross-over | 33 | 5.4 |
| Washing + cross-over | 18 | 4.3 (washing water supplied, 7 1/min.) |
| Squeezing | 40 | 3.1 |
| Drying | 50 | 4.4 |
| | (Total) | 25.0 |

Evaluation of silver image tone

Samples were each sandwiched between radiographic intensifying screens, SRO-250 (produced by Konica Corp.), exposed to X-ray so as to give a density of 1.2, and processed. Processing was conducted employing an automatic processor, modified SRX-503 (Produced by Konica Corp.), at a total processing time of 25 sec. Samples were evaluated at the initial stage of process, using fresh solutions and also at the stage of running process. Thus each sample was continually processed and evaluated at the stage in which activity of the processing solution reached steady state. The replenishing rate of a developing solution or fixing solution in the running process was 100 ml/m$^2$. Processed samples were each observed on the viewing box and tone (color) of transmission-type silver images was visually evaluated, based on the following criteria:

A: Neutral black

B: Slightly reddish black

C: Slightly yellowish black

D: Yellowish black

Evaluation of development unevenness

Processed samples employed in the above evaluation of silver image tone were also visually evaluated with respect to unevenness of developed silver images (uneven density), based on the following criteria:

A: No unevenness observed

B: Slight unevenness observed.

C: Marked unevenness observed (not commercially viable)

D: Overall unevenness

Evaluation of process stability

Samples were each sandwiched between radiographic intensifying screens, SRO-256 )produced by Konica Corp.) and exposed to X-ray at a tube voltage of 90 kVp and 20 mA for 0.05 sec. According to the method, a sensitometric curve was prepared to determine sensitivity, which was defined as the reciprocal of exposure of X-ray necessary for obtaining a density of fog plus 1.0. Processing was conducted in the same manner as above-described, and sensitivity difference between when developed with fresh solution and when developed with running solution. The sensitivity difference was represented as a relative value, based on the sensitivity of fresh solution process being 100. The less the difference, the more superior the process stability.

Results are shown in Table 1.

TABLE 1

| Sample No. | Emul-sion | Cl-content (mol %) | $a_1$ | $a_2$ | $a_3$ | Leueo compound (mol/m$^2$) | Silver tone Fresh | Silver tone Running | Development unevenness Fresh | Development unevenness Running | Process stabi-lity | Re-mark |
|---|---|---|---|---|---|---|---|---|---|---|---|---|
| 1 | Em-1 | 99 | 0.91 | 4.5 | 0.97 | — 0 | C | D | A | B | 14 | Comp. |
| 2 | Em-1 | 99 | 0.91 | 4.5 | 0.97 | I-5 ($2.0 \times 10^{-4}$) | A | A | A | A | 5 | Inv. |
| 3 | Em-5 | 99 | 0.90 | 4.5 | 0.4 | I-5 ($2.0 \times 10^{-4}$) | B | C | A | B | 17 | Comp. |
| 4 | Em-6 | 99 | 0.90 | 4.5 | 0.6 | I-5 ($2.0 \times 10^{-4}$) | A | A | A | A | 8 | Inv. |
| 5 | Em-2 | 60 | 0.91 | 4.5 | 0.97 | I-5 ($2.0 \times 10^{-4}$ | A | A | A | A | 6 | Inv. |
| 6 | Em-3 | 40 | 0.91 | 4.5 | 0.97 | I-5 ($2.0 \times 10^{-4}$) | B | C | B | C | 29 | Comp. |
| 7 | Em-4 | 99 | 0.95 | 9.5 | 0.90 | I-5 ($2.0 \times 10^{-4}$) | A | A | A | A | 3 | Inv. |
| 8 | Em-4 | 99 | 0.95 | 9.5 | 0.90 | II-1 ($2.0 \times 10^{-4}$) | A | A | A | A | 4 | Inv. |
| 9 | Em-4 | 99 | 0.95 | 9.5 | 0.90 | III-1 ($2.0 \times 10^{-4}$) | A | A | A | A | 3 | Inv. |
| 10 | Em-4 | 99 | 0.95 | 9.5 | 0.90 | V-1 ($2.0 \times 10^{-4}$) | A | A | A | A | 5 | Inv. |
| 11 | Em-4 | 99 | 0.95 | 9.5 | 0.90 | — 0 | D | D | A | B | 15 | Comp. |
| 12 | Em-7 | 99 | 0.30 | 2.2 | 0.99 | I-5 ($2.0 \times 10^{-4}$) | B | C | B | C | 21 | Comp. |

As can be seen from the Table, invention samples were proved to be superior in silver image tone, little in development unevenness and improved in process stability.

Example 2

Solid processing compositions were prepared in the following manner.

Solid developing composition

Preparation of granules (A)

1-Phenyl-3-pyrazolidone of 300 g, N-actyl-D,L-penicillamine of 10 g and sodium glutaraldehyde bissulfite of 500 g each were pulverized up in a commercially available mill so as to have an average particle size of 10 $\mu$m. To the resulting fine particles, were added 1500 g of sodium metabisulfite, 4000 g of sodium erythorbate, and 600 g of D-sorbit, and the mixture was mixed in the mill for 30 min. In stirring granulator commercially available, the resulting mixture was granulated for 10 min. at room temperature by adding 30 ml of water. The resulting granules were dried up at 40° C. for 2 hr. in a fluidized bed drier so that the moisture content of the granules was almost completely removed off.

Preparation of solid developing composition A

To the thus prepared granules (A) was added 80 g of sodium 1-octanesulfonate and mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc to obtain a developing composition in the form of a tablet containing a reductone type developing agent.

Preparation of Granules (B)

Potassium carbonate of 9000 g and sodium bicarbonate of 100 g each were pulverized up in a commercially available mill so as to have an average particle size of 10 $\mu$m. To the resulting fine particles, 250 g of DTPA-5H, 45 g of 1-(3-sulfophenyl-sodium)-5-mercaptotetrazole, 10 g of sodium 5-mercapto-tetrazole-1-acetate, 7 g of KI, 200 g of methyl-β-cyclodexrine, 2000 g of Mannitol and 700 g of D-sorbit were added and mixed in the mill for 30 min. In stirring granulator commercially available, the resulting mixture was granulated for 15 min. at room temperature by adding 30 ml of water. The resulting granules were dried up at 40° C. for 2 hr. in a fluidized bed drier so that the moisture content of the granules was almost completely removed off.

Preparation of solid developing composition B

To the thus prepared granules (A) was added 150 g of sodium 1-octanesulfonate and mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc to obtain a developing composition in the form of a tablet containing an alkaline agent.

The developing compositions in the form of a tablet A and B were packaged into a pillow bag containing aluminum for moisture-proof, in an amount of 4.0 liters of the developing solution.

A solid fixing composition was prepared in the following manner.

Granules (C)

Ammonium thiosulfate/sodium thiosulfate (90/10 by weight) of 15,000 g was pulverized up in a commercially available mill so as to have an average particle size of 10 $\mu$m. To the resulting fine powder, were added sodium sulfite of 500 g, $Na_2S_2O_5$ of 750 g and binder Pineflow of 1,300 g and the mixture was mixed in the mill for 3 min. In stirring granulator commercially available, the resulting mixture was granulated by adding 50 ml of water. The resulting granules were dried up at 40° C. in a fluidized bed drier so that the moisture content of the granules was almost completely removed off.

Granules (D)

Boric acid of 400 g, aluminum sulfate octahydrate of 1,200 g, cinnamic acid of 1200 g and tartaric acid of 300 g were pulverized up in a commercially available mill so as to have an average particle size of 10 $\mu$m. To the resulting fine particles was added D-mannit of 250 g, D-sorbit of 120 g and PEG #4000 of 160 g and the resulting mixture was granulated by adding 30 ml of water. The resulting granules were dried up at 40° C. in a fluidized bed drier so that the moisture content of the granules was almost completely removed off.

Preparation of solid fixing composition

To the thus prepared granules (C) were added β-alanine of 3000 g, sodium acetate of 4330 g and sodium 1-octanesulfonate in an amount so as to be 1.5% of the total weight, to granule (D) were added sodium metabisulfite of 750 g and sodium 1-octanesulfonate in an amount so as to be 1.0% of the total weight, and each mixed for 10 min. by making use of a mixer in a room controlled to be not higher than 25° C. and 40% RH. Each of the mixture was compression-tableted so as to have a filling amount of 10.2 g per tablet (C) and 11.2 g per tablet (D), by making use of a tableting machine that was modified model of Tough Press Collect 1527HU manufactured by Kikusui Mfg. Works, Inc. Thus prepared fixing compositions C and D in the form of a tablet were each packaged into a pillow bag containing aluminum for moisture-proof, in an amount for 4 liters of the fixing solution.

There was employed an automatic processor, modified SRX-201 (produced by Konica Corp.). Processing was conducted at a developing temperature of 35° C. and at a fixing temperature of 35° C. for a overall processing time (Dry to Dry) of 40 sec.

A starting developer solution in a developing tank was prepared so as to dissolve packaged tablets of developing composition-tablet in 4 liters of water using a modified chemical mixer. In this case, the tablets were completely dissolved and no precipitate was observed. Thus prepared developing solution of 7.8 l was introduced into the processor, modified SRX-201 and a starter having the composition as below was added thereto in amount of 35 ml/l to prepare a starting developing solution. A fixing solution for use in the processor was prepared so as to dissolve packaged fixing composition-tablets in 4 liters of water using the chemical mixer. In the thus prepared fixing solution, the tablets were completely dissolved and no precipitate was observed. The fixing solution of 5.6 liters was introduced into a processor SRX-201 as a starting fixer solution.

| Starter | |
|---|---|
| KBr | 5.5 g |
| $HO(CH_2)_2S(CH_2)_2(CH_2)_2OH$ | 0.05 g |
| N-acetyl-D,L-penicilamine | 0.10 g |
| Sodium metabisulfite for pH-adjustment | |
| Water to make | 35 ml |

In SRX-201, an inlets of a modified chemical mixer for supplying each of the developing and fixing solid compositions was provided and a built-in chemical mixer was modified for dissolving the solid processing composition.

An opened package of solid developing or fixing composition tablets was set at the inlet of modified chemical mixer and at the same time when the tablets was supplied into the tank, warm water (25 to 30° C.) was also introduced to prepare the processing solution of 4.0 liter, with stirring and dissolving for 25 min. The resulting solution was used as a replenishing solution for developing or fixing solution. The pH of the developing solution and fixing solution was respectively adjusted to 10.15 and 4.80 with acetic acid or potassium hydroxide. The built-in chemical mixer was comprised of a supplying tank and an auxiliary tank, each having a volume of 4 liters. The auxiliary tank was provided so as to supply a replenishing solution, without no supply of the replenishing solution, during the time a replenishing solution prepared in the supplying tank was exhausted during the running process and the solid processing compositions were being dissolved for a period of 25 min. The starter was added and the pH of the developer stating solution was adjusted to 9.90.

Based on the processing conditions above-described, photographic material samples were also evaluated with respect to silver image tone, development unevenness and process stability in the same manner as in Example 1. As a result, the inventive samples were proved to be superior in any of them and there were obtained similar results to Example 1.

What is claimed is:

1. A silver halide light sensitive photographic material comprising a support having thereon a silver halide emulsion layer containing silver halide grains, wherein at least 50% of the total projected area of silver halide grains contained in the silver halide emulsion layer is accounted for by tabular silver halide grains having an aspect ratio of 2 to 15, (100) major faces with an edge ratio of 1 to 2, and a silver chloride content of 50 mol % or more; and said emulsion layer further containing a leuco compound capable of forming a blue dye upon reaction with an oxidation product of a developing agent.

2. The silver halide photographic material of claim 1, wherein said tabular grains have an average diameter of 0.15 to 5.0 $\mu$m and an average thickness of 0.01 to 1.0 $\mu$m.

3. The silver halide photographic material of claim 1, wherein said tabular grain further have an average silver iodide-content of 3.0 mol % or less.

4. The silver halide photographic material of claim 1, wherein said tabular grains are chemically sensitized in the presence of a selenium compound or a tellurium compound.

5. The silver halide photographic material of claim 1, wherein said leuco compound is represented by the following formulas (I) through (VII):

Formula (I)

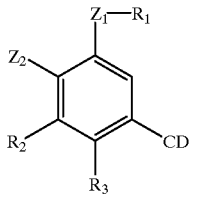

Formula (II)

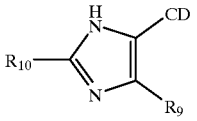

Formula (III)

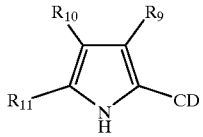

Formula (IV)

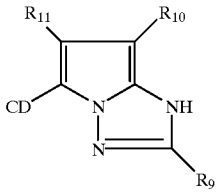

Formula (V)

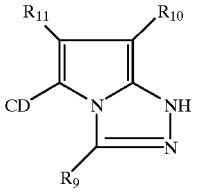

-continued

Formula (VI)

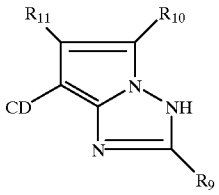

Formula (VII)

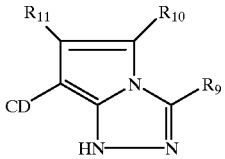

wherein $R_1$ represents an aryl group or a heterocyclic group; $R_2$ represents a hydrogen atom, an alkyl group or a halogen atom; $R_3$ represents a hydrogen atom, an alkyl group or an acylamino group; $Z_1$ represents —NHCO—, —CONH— or —NHCONH—; $Z_2$ represents —OH or —$NHSO_2R_{12}$, in which $R_{12}$ represents an alkyl group or an aryl group; $R_9$, $R_{10}$ and $R_{11}$ independently represent a hydrogen atom or a substituent, provided that $R_{10}$ and $R_{11}$ may combine with each other to form a ring; and CD is represented by the following formula (CD):

formula (CD)

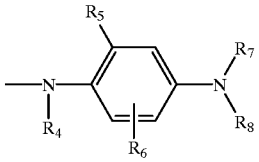

wherein $R_4$ represents a hydrogen atom, —$COR_{13}$ or —$SO_2R_{13}$, in which $R_{13}$ represents an alkyl group or an aryl group; $R_5$ and $R_6$ independently represent a hydrogen atom, an alkyl group, an alkoxy group, acylamino group or a halogen atom; $R_7$ and $R_8$ independently represent a hydrogen atom, an alkyl group, an aryl group or an acyl group, or represent an atomic group necessary to form a 5- or 6-membered N-containing ring by combination with each other or an atomic group necessary to form a 5- or 6-membered N-containing fused ring with the phenyl ring to which the N atom is attached.

6. The silver halide photographic material of claim 1, said leuco compound is contained in an amount of $1\times10^{-6}$ to $5\times10^{-2}$ mol per mol of silver halide.

7. The silver halide photographic material of claim 1 wherein the edge ratio is 1 to 1.2.

8. The silver halide photographic material of claim 5 wherein said tabular grains have an average diameter of 0.15 to 5.0 $\mu$m, an average thickness of 0.01 to 1.0 $\mu$m and an average iodide content of 3.0 mol % or less.

9. The silver halide photographic material of claim 5 wherein said tabular grains have an average diameter of 0.4 to 2.0 $\mu$m.

10. The silver halide photographic material of claim 5 wherein said tabular grains have an aspect ratio of 5 to 10.

* * * * *